US009273843B2

(12) United States Patent
Spinger et al.

(10) Patent No.: US 9,273,843 B2
(45) Date of Patent: Mar. 1, 2016

(54) LED FRONT LIGHTING ARRANGEMENT

(75) Inventors: Benno Spinger, Aachen (DE); Nils Benter, Düsseldorf (DE); Josef Andreas Schug, Wuerselen (DE)

(73) Assignee: Koninklijke Philips N.V., Eindhoven (NL)

( * ) Notice: Subject to any disclaimer, the term of this patent is extended or adjusted under 35 U.S.C. 154(b) by 29 days.

(21) Appl. No.: 13/641,772

(22) PCT Filed: Apr. 12, 2011

(86) PCT No.: PCT/IB2011/051560

§ 371 (c)(1),
(2), (4) Date: Oct. 17, 2012

(87) PCT Pub. No.: WO2011/132111

PCT Pub. Date: Oct. 27, 2011

(65) Prior Publication Data

US 2013/0033864 A1 Feb. 7, 2013

(30) Foreign Application Priority Data

Apr. 19, 2010 (EP) ..... 10160318

(51) Int. Cl.
*F21V 7/00* (2006.01)
*F21S 8/10* (2006.01)
(Continued)

(52) U.S. Cl.
CPC ..... *F21S 48/1154* (2013.01); *F21S 48/1104* (2013.01); *F21S 48/137* (2013.01);
(Continued)

(58) Field of Classification Search
CPC ..... F21S 48/1159; F21S 48/1154; F21S 48/1388; F21S 48/115; F21S 48/1364; F21Y 2101/02; F21V 7/09; F21V 13/04; F21V 7/0058; F21V 7/0066; H01L 33/60
USPC ..... 362/459, 538, 460, 487, 509, 512, 514, 362/516, 517, 518, 519, 235, 296.01–297, 362/311.02, 346–347
See application file for complete search history.

(56) References Cited

U.S. PATENT DOCUMENTS 4,914,747 A 4/1990 Nino
7,121,704 B2 * 10/2006 Takada ..... 362/516
(Continued)

FOREIGN PATENT DOCUMENTS

DE 1156727 B1 11/1963
DE 202007009004 U1 4/2007
(Continued)

*Primary Examiner* — Sean Gramling
(74) *Attorney, Agent, or Firm* — Patent Law Group LLP; Brian D. Ogonowsky

(57) ABSTRACT

A lighting arrangement for use in automotive front lighting and a method of producing such an arrangement are described. At least one LED lighting element 40 is provided for emitting light. A collimator 10 is provided for forming an emission pattern of the emitted light, which is subsequently projected by a secondary optic arrangement 42. The collimator 10 comprises a cutoff reflector surface 18 with a front edge 30 and a back edge 32. The back edge 32 is located adjacent to the LED lighting element 40. The front edge is spaced from the back edge 32 in a depth direction X, A. The front edge 30 is arranged as a shielding edge for forming a light/dark cutoff in the emission pattern. First and second lateral reflector surfaces 26*a*, 26*b* are arranged opposite to each other adjacent to the LED lighting element 40. The front edge 30 of the cutoff reflector surface 18 is arranged within a focal area of the secondary optic arrangement 42. For providing a beam pattern well suited for automotive front lighting, the first and second lateral reflector surfaces 26*a*, 26*b* extend further into the depth direction A, X than the cutoff reflector surface 18.

14 Claims, 6 Drawing Sheets

(51) Int. Cl.
*F21V 7/09* (2006.01)
*F21V 13/04* (2006.01)

(52) U.S. Cl.
CPC ..... *F21S48/1335* (2013.01); *F21S 48/1388* (2013.01); *F21S 48/145* (2013.01); *F21V 7/0058* (2013.01); *F21V 7/0066* (2013.01); *F21V 7/09* (2013.01); *F21V 13/04* (2013.01)

(56) References Cited

U.S. PATENT DOCUMENTS

| | | | | |
|---|---|---|---|---|
| 7,578,605 | B1 * | 8/2009 | Mullins et al. | 362/297 |
| 2003/0185017 | A1 | 10/2003 | Ishida | |
| 2004/0130907 | A1 * | 7/2004 | Albou | 362/517 |
| 2006/0239020 | A1 | 10/2006 | Albou | |
| 2006/0262552 | A1 * | 11/2006 | Komatsu et al. | 362/539 |
| 2008/0225540 | A1 | 9/2008 | Tsukamoto | |
| 2008/0285295 | A1 * | 11/2008 | Schug | 362/487 |
| 2008/0316760 | A1 * | 12/2008 | Schug et al. | 362/516 |
| 2009/0009045 | A1 | 1/2009 | Schug | |
| 2009/0122567 | A1 | 5/2009 | Mochizuki | |
| 2010/0046243 | A1 | 2/2010 | Yatsuda | |
| 2011/0026266 | A1 * | 2/2011 | Sasaki et al. | 362/516 |
| 2013/0003402 | A1 * | 1/2013 | Chao | 362/520 |

FOREIGN PATENT DOCUMENTS

| | | | |
|---|---|---|---|
| DE | 102009037698 | A1 | 3/2010 |
| EP | 0786622 | A1 | 7/1997 |
| EP | 0843126 | A2 | 5/1998 |
| EP | 1559952 | A2 | 8/2005 |
| JP | 2004063499 | A | 2/2004 |
| JP | 2006066399 | A | 3/2006 |
| JP | 2010049886 | A | 3/2010 |
| JP | 2010067380 | A | 3/2010 |
| WO | 2006033042 | A1 | 3/2006 |
| WO | 2009122364 | A1 | 10/2009 |

* cited by examiner

LED FRONT LIGHTING ARRANGEMENT

FIELD OF THE INVENTION

The present invention relates to a lighting arrangement, and more specifically to a lighting arrangement that includes an LED lighting element and may be used in automotive front lighting.

BACKGROUND OF THE INVENTION

While LED lighting elements with their inherent advantages such as high efficiency and long lifetime are already used in many applications today, the use in automotive front lighting is still limited.

Already today, LED lighting elements are available with sufficient luminous flux for automotive front lighting. For example, LUXEON Altilon LED elements available from Philips Lumileds are designed for such applications.

However, LED elements are generally Lambertian emitters, i.e. do not generate a directed beam of light. On the other hand, motor vehicle headlamps are required to emit a specific beam pattern. For a low beam light, the beam pattern must have a sharp light/dark cutoff, i.e. a horizontal or slightly inclined line, below which the road ahead of the vehicle is brightly illuminated, whereas above the bright/dark cutoff line light is shielded to avoid glare.

WO 2006/033042 describes a lighting arrangement with an LED lighting element, where a desired beam is formed by a collimator element and by secondary optics. The collimator comprises opposing first and second reflector faces arranged close to the LED element. The first reflector face has a first edge, where a sharp cutoff is produced. The second reflector face has an upper section arranged inclined to a sectional plane and a lower section with less inclination. The LED collimator element is further delimited by lateral reflector faces, which are inclined outwards in the emission direction.

DE 10 2009 037 698 describes an automotive lighting unit. Light emitted from an LED light source is formed into a light pattern by an optical element, and a lens is used to project the light pattern. The optical element comprises a first reflective surface arranged horizontally under the optical axis of the LED light source and a second reflective surface above the optical axis. The first reflective surface comprises an edge of elliptical shape, which is arranged within a focus group of the projection lens. The second reflective surface is bent conically and is shaped to have a focus at or near the LED light source. A resulting light pattern comprises a portion of light Ha emitted directly from the LED element without reflection, a portion Hb reflected at the first reflective surface, and a portion Hc reflected at the second reflective surface.

US 2009/0122657 discloses a projection-type light source unit with an LED module as light emitting device, a reflector, a cut-off line forming shade, and a projection lens. The optical axis of the LED chip is oriented in a direction perpendicular to the optical axis of the light source unit. Light emitted from the LED chip is reflected by a reflector and concentrated at a point A near the rear focus of the projection lens. The projection lens projects an image formed on the focal plane, so that a light distribution for low beam with a clear cut-off line is formed.

WO 2009/122364 describes a projection module for a motor vehicle headlamp. An LED light source is surrounded by a reflector housing used as a collimator. A horizontal lower edge of the collimator lies on the centre axis of a lens, and is positioned within the focal plane of the lens, having a curvature corresponding to the different geometric spacings of the edge. The edge is provided with a 15° slope to generate a desired light distribution with a light-dark boundary for a low beam headlamp.

SUMMARY OF THE INVENTION

It is an object of the invention to provide a lighting arrangement for generating, from the light emitted by an LED lighting element, a beam pattern well suited for automotive front lighting.

This object is solved by a lighting arrangement according to claim 1 and by a method for producing a lighting arrangement according to claim 13. Dependent claims refer to preferred embodiments of the invention The present inventors have considered that beam emission patterns for automotive front lighting are required to have a wide beam in lateral direction. They have recognized that a relatively large arrangement including the secondary optics may be required to achieve the desired wide emission angles in prior art arrangements.

In the lighting arrangement according to the invention, an LED lighting element, a collimator and a secondary optic arrangement are provided. The LED lighting element emits light, of which the collimator forms an emission pattern, which is subsequently projected by the secondary optic arrangement. The term "LED lighting element" is intended to comprise any type of electroluminescent element or group of such elements. Preferably, the LED lighting element is a semiconductor LED emitting light in non-directional manner over an emission plane.

The secondary optic arrangement is preferably a single lens, but may equally be a reflector or a group of lenses and/or reflective surfaces. The secondary optic arrangement has a focal area, where light from this focal area is projected substantially parallel.

The collimator according to the invention has a shape designed to form a desired emission pattern of the light from the LED lighting element. To achieve this, the collimator comprises different reflector surfaces arranged to reflect portions of the light such that in essence a lighting pattern is formed that is collimated, i.e. has in at least one direction a more limited emission angle than the light from the LED element.

In the following, the shape of different elements of the collimator will be described. As far as in the description of this shape terms referring to directions or dimensions such as forward, backward, lateral, height etc., are used, these refer to the orientation of the lighting arrangement within the front headlight of a motor vehicle. Such terms are used here only to aid in understanding of the shape and relative positioning and orientation of the different surfaces and are therefore to be understood illustrative rather than limiting. It is understood by the skilled person that the lighting arrangement may alternatively be used in other orientations, where the terms referring to direction or orientation will no longer apply.

A first reflector surface of the collimator is a cutoff reflector surface. This cutoff reflector surface has a back edge located adjacent to the LED lighting element. An opposing front edge is spaced from the back edge in a depth direction.

The depth direction preferably coincides with an optical axis X defined by the secondary optics. Preferably a focal point of the secondary optics is located on the optical axis. In the preferred case of a lens in the secondary optical arrangement the optical axis is defined through the center of the lens. In the further preferred case of a planar LED lighting element, the optical axis and the depth direction are at least substantially perpendicular (i. e. 85-95°) on a light emission plane of the LED lighting element. Further, the optical axis preferably passes just above a cutoff or shielding edge which will be described below.

The front edge, which is thus arranged at a distance from the LED lighting element, is arranged as a shielding edge forming a light/dark cutoff in the emission pattern. Thus, the cutoff reflector surface is illuminated by the LED lighting element up to this shielding edge. Those portions of the emitted light that strike the cutoff reflector surface are reflected and thus shielded, such that a shielded (dark) portion of the emission pattern is generated, whereas other portions of the light pass by the shielding edge forming unshielded (light) portions of the emission pattern.

The thus generated sharp light/dark cutoff resulting from illumination of the front edge of a cutoff reflector surface is projected by the secondary optic arrangement. Since the front edge is arranged in a focal area of the secondary optic arrangement, the sharp cutoff is maintained in the projected emission pattern. This sharp projection depends both on the optical properties of the secondary optic arrangement and the shape of the front edge. As will become apparent when discussing preferred embodiments, the shielding edge may have different shapes including a varying profile in depth direction. Generally, for fulfilling the requirement of a strong light/dark cutoff, it will be sufficient if a portion, e.g. the center of the shielding edge is arranged in a focal area of the secondary optic arrangement, e.g. projection lens, i.e. within a region where the projection will be substantially parallel. In the case of a secondary optic arrangement with a precise focal point, it will be sufficient to arrange a portion of the shielding edge at the focal point +/−10% of the focal distance of the secondary optic arrangement.

The collimator further comprises first and second lateral reflector surfaces. These are arranged opposite each other with back edges adjacent to the LED lighting element and both extend from the LED lighting element into the depth direction.

According to the invention, the first and second lateral reflection surfaces extend further into the depth direction than the cutoff reflector surface. The inventors have recognized that the lateral reflector surfaces may serve to extend a lateral emission angle. Portions of the light emitted from the LED lighting element will be reflected at the lateral reflector surfaces, such that a broad emission in the lateral direction is achieved. However, the lateral surfaces do not include shielding edges within the focus of the secondary optics, such that the resulting emission pattern has no sharp light/dark cutoff in lateral direction. Instead, the lateral surfaces extend further in the depth direction, beyond the focal point of the secondary optic arrangement, such that an emission pattern with a gradual decreasing intensity in lateral direction is formed. Preferably, the lateral reflector surfaces extend, measured from the LED lighting element into the depth direction, at least 50% further than the shielding edge, preferably more than twice as far, to produce the desired gradual transition and broad emission in lateral direction.

Together with the secondary optic arrangement this shape of the collimator provides an emission pattern well suited for automotive front lighting. The corresponding lighting arrangement is very compact, because the broad emission in lateral direction results from a reflection of the light emitted from the LED lighting element at the lateral surfaces, that extend in depth direction beyond the focal area of the secondary optic arrangement.

In a preferred embodiment of the invention, the collimator further comprises a foreground reflector surface. The reflector surface is arranged opposite to the cutoff reflector surface, however preferably at an angle (i.e. not parallel) thereto. The foreground reflector surface also extends further into the depth direction than the cutoff reflector surface, i.e. also beyond the focal area of the secondary optic arrangement. When used in a motor vehicle headlight, the foreground reflector surface provides, by reflection of portions of the light emitted from the LED lighting element, an illumination of the road directly in front of the vehicle, i.e. substantially below the optical axis. By providing the foreground reflector surface to extend into the depth direction beyond the focal area, the resulting foreground illumination within the emission pattern also has no light/dark cutoff.

In a preferred embodiment, the collimator is comprised of the cutoff reflector surface, foreground reflector surface and lateral reflector surfaces. Each of these are arranged with the back edges adjacent to the LED lighting element. The back edges then form a window for the light emitted from the LED lighting element. The reflector surfaces may be arranged in parallel to the central geometrical axis through this window, but preferably are provided under an opening angle formed between the surfaces and the central geometrical axis. Thus, a first, main portion of the light emitted from the LED lighting element is emitted directly without reflection at the reflector surfaces, whereas the reflector surfaces serve to modify the emission pattern in directions greater than the corresponding opening angles.

It should be understood that the reflector surfaces need not be planar, but may comprise one or both of a curvature or differently angled portions. However, it is preferred for the surfaces to be quasi-continuous, which is understood in a sense that the surface has—except for the defined edges and a bent or angled portion (kink) of the shielding edge—no sharp bends with a bending radius of less than 0.3 mm.

In a further preferred embodiment, the lateral reflector surfaces are arranged under a defined opening angle. The opening angle may be measured in a central sectional plane of the LED lighting element. The opening angle preferably has a value of 5°-65°, most preferably 10°-45° with a central geometrical axis. Whereas the angle may be measured directly in the case of a straight shape of the lateral reflector surface, it may in the case of a lateral reflector surface with curvature be measured between the central axis and a line drawn between the back edge and front edge of the lateral reflector surface.

According to a further preferred embodiment, at least one of the lateral reflector surfaces has, in cross-sectional view, a shape with varying opening angles. The reflector surface may include a first and a second angle portion of different opening angles with a central axis. A first angle portion closer to the LED element may have a larger opening angle, whereas a second angle portion, which preferably has a smaller opening angle, is arranged further away from the LED lighting element. Optionally, there may also be a third angle portion provided even further away from the LED lighting element than the second angle portion, which has a larger angle than the second angle portion. It is further preferred that the shape of the lateral surface is continuous between these portions. The cross-section of the lateral surface is preferably taken in a central plane of the LED lighting element, including the central axis. Further preferred, both lateral reflector surfaces may be provided with the discussed different angle portions.

The front edge of the first reflector surface, i.e. the shielding edge for forming the light/dark cutoff, may be at least substantially straight. According to preferred embodiments of the invention, however, the shielding edge may have a more complex shape.

It may be preferred for the shielding edge to be provided as a curve with varying distance from the LED lighting element in the depth direction. Further preferred, the shape of this curve is such that a centrally arranged portion of the shielding edge is arranged closest to the lighting element, whereas outer portions of the shielding edge are further distant from the LED lighting element in the depth direction.

Further, the shielding edge may vary from a straight line shape also in a horizontal direction. Preferably, the shape of the front edge of the first reflector surface comprises two portions extending at least substantially straight (as viewed in the direction of the central axis) and an angle portion arranged in between these straight portions. The straight portions may be arranged at least substantially in parallel, i. e. at an angle with each other only up to 5°. Alternatively, there may be provided a first, substantially horizontal straight portion and a second straight portion at an inclination of 5°-20° thereto.

This special shape of the cutoff edge serves to achieve a corresponding shape in the projected emission pattern conforming to automotive front lighting standards.

The collimator may be made of different materials, for example of bent metal sheets to form the respective surfaces. However, according to a preferred embodiment, at least one of the surfaces of the collimator (cutoff reflector surface, lateral reflector surfaces, foreground reflector surface) is formed of a part made of plastic provided with a reflective coating on its surface. A corresponding plastic part may be made e.g. by injection moulding. A reflective surface coating may be provided on it by depositing a layer of e. g. Silver or Aluminum, which may be covered by a protective layer. The layer may be provided e. g. by spray coating or by evaporation.

According to a further preferred embodiment, the collimator comprises two or more plastic parts. These may be provided with different types of reflective coatings.

The different types of reflective coating may differ e. g. by the provided reflective coating material, by thickness or surface properties, such that different reflective properties are achieved. Preferably, the cutoff reflector surface, which may e. g. be made by evaporation, has better reflective properties than the lateral surfaces, which may e. g. be made by spray coating. Thus, for this most important reflector surface a high quality (and expensive) reflective coating may be chosen, whereas for the lateral surfaces a less expensive reflective coating may be provided.

According to a preferred embodiment, the LED lighting element has a light emitting plane of asymmetrical dimensions. Specifically, it is preferred that the plane, which preferably is of rectangular shape, has a larger width than height. This corresponds to the desired beam emission pattern with a wide lateral emission angle.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
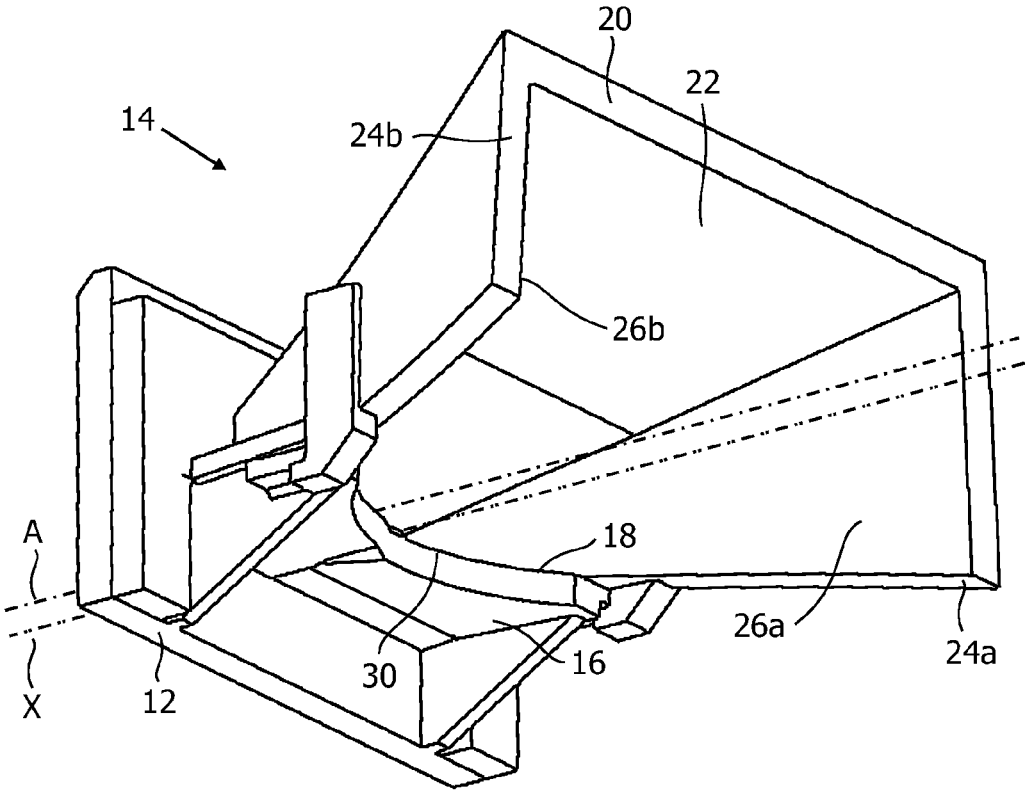
FIG. 1 shows an embodiment of a collimator element in a perspective view.
Figure 2:
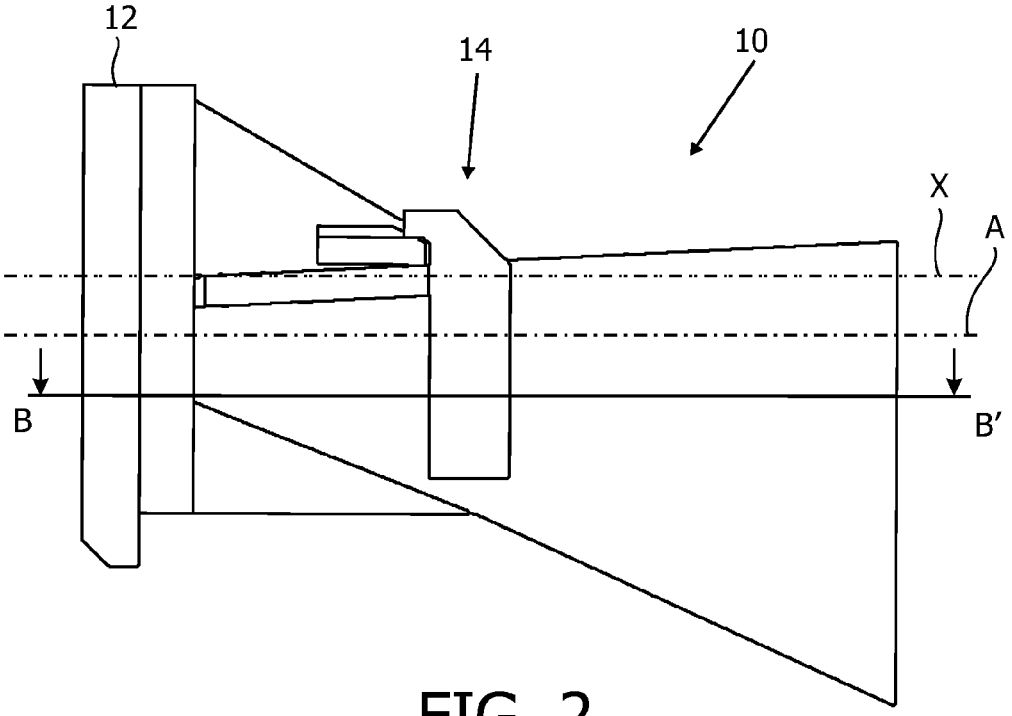
FIG. 2 shows the collimator element of FIG. 1 in a side view.

FIG. 1 shows a collimator element 10 including a back plate 12 and an opening funnel 14 extending from the back plate 12, which funnel 14 surrounds a central geometrical axis A. The funnel 14 is comprised of a cutoff reflector wall 16 with an inner cutoff reflector surface 18, a foreground reflector wall 20 with an inner foreground reflector surface 22 and lateral reflector walls 24 *a*, 24 *b* with lateral reflector surfaces 26 *a*, 26 *b*. The reflector walls 16, 20, 24 *a*, 24 *b* and the back plate 12 are all made of plastic in an injection molding process. The surfaces 18, 22, 26 *a*, 26 *b* are made by providing a reflective surface on the corresponding wall element.

Figure 4:
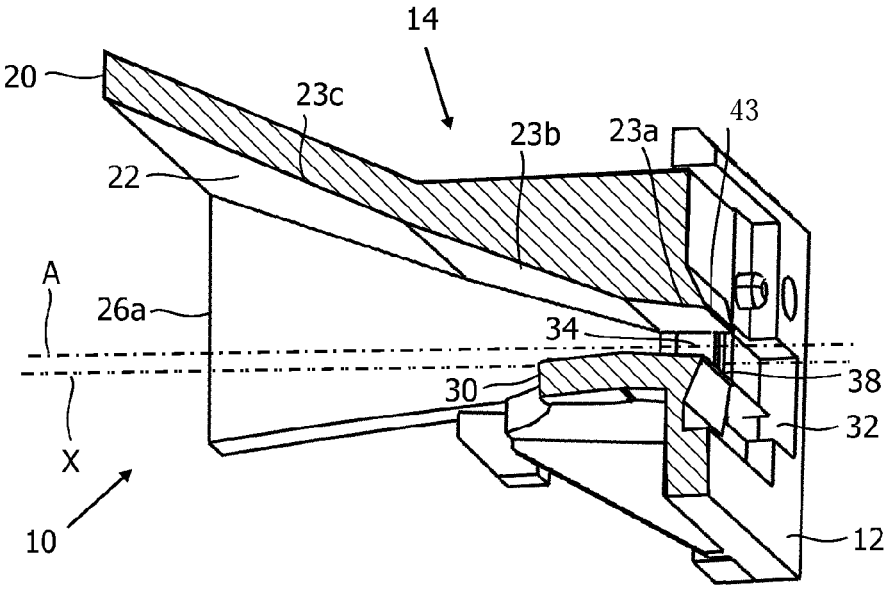
FIG. 4 shows in a perspective view the collimator element of FIGS. 1-3 cut along the line C . . . C' in FIG. 3.
Figure 5:
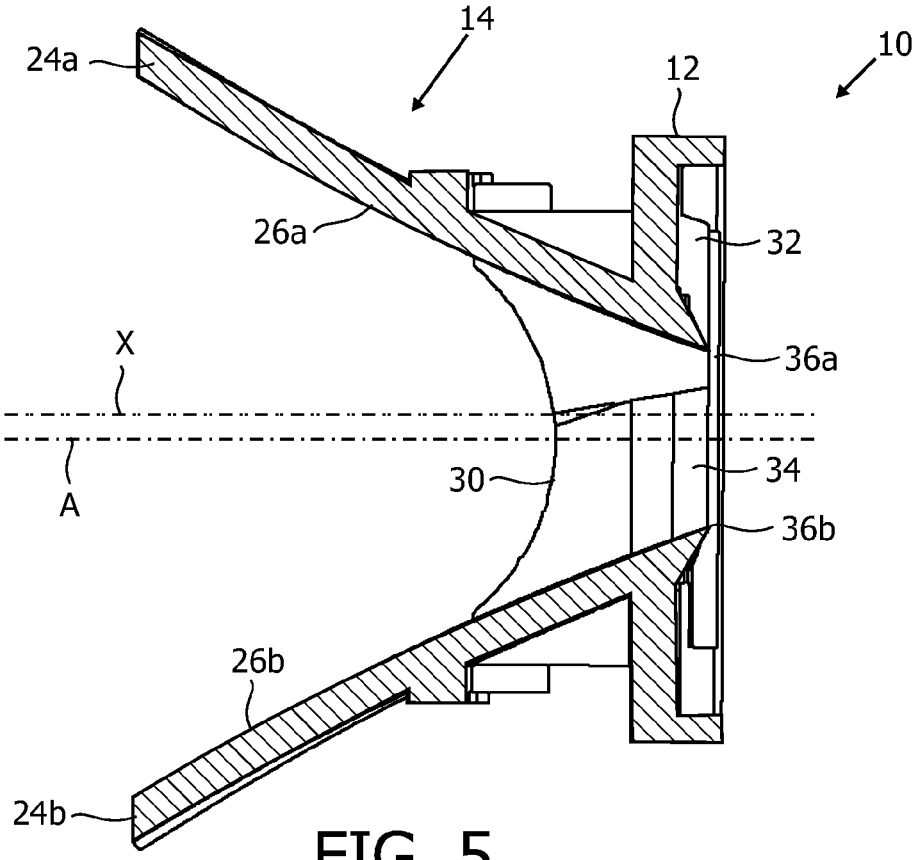
FIG. 5 shows a sectional view of the collimator element of FIGS. 1-4 with the section taken along line B . . . B' in FIG. 2.
Figure 10:
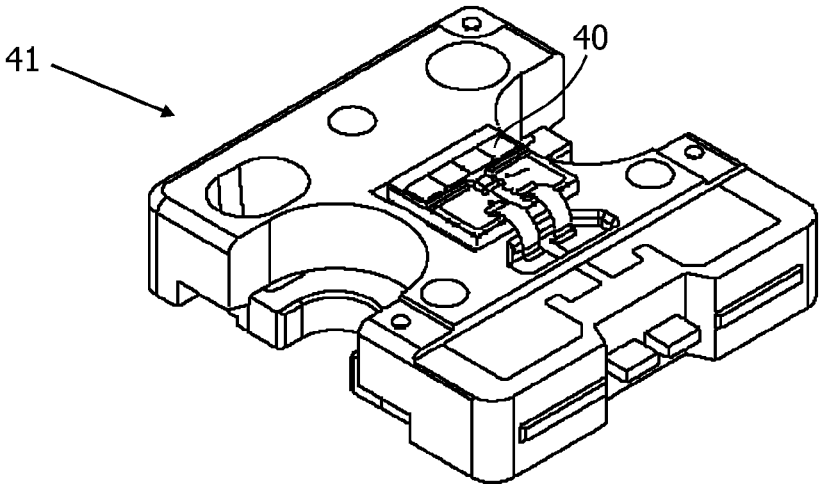
FIG. 10 shows a perspective view of an LED lighting module with an LED lighting element.

As visible in the sectional views of FIG. 4, FIG. 5, the back plate 12 comprises a mounting cavity for a high power LED lighting module 41 as shown in FIG. 10. The LED lighting module 41 comprises as actually light emitting element an LED lighting element 40 which has a planar light emitting surface. The central geometrical axis A is defined perpendicular on the center of the rectangular light emitting area of the lighting module 41.

A preferred embodiment of the LED lighting module 41 to be used is a LUXEON Altilon LED element available from Philips Lumileds which has an electrical power rating of e.g. presently 15 W and provides a luminous flux of more than 850 lm. The LED lighting element 40 has a planar lighting surface area of asymmetrical dimensions, i.e. shorter in height than in width direction. Preferred aspect ratios may range from e.g. 2:1 to 6:1.

As further visible in FIGS. 4, 5, the funnel 14 provides a window 34 through which the light emitted from the LED lighting element 40 of the module 41 mounted within the mounting cavity 32 is emitted. The window 34 is bordered by back edges of the reflective surfaces of the funnel 14, namely back edges 36 *a*, 36 *b*, as shown in FIG. 5, of the lateral reflector surfaces 26*a*, 26 *b* laterally bordering the window 34 and, as shown in FIG. 4, back edges 38, 43 of the cutoff reflector surface 18 and the foreground reflector surface 22, bordering the window 34 from above and below, respectively.

If the LED module 41 is installed in the mounting cavity 32 such that the LED lighting element 40 is positioned at the window 34, the back edges 38, 43, 36 *a*, 36 *b* are arranged directly adjacent to the LED lighting element 40, i.e. preferably with a distance of less than 1 mm, further preferred less than 0.5 mm.

Figure 6:
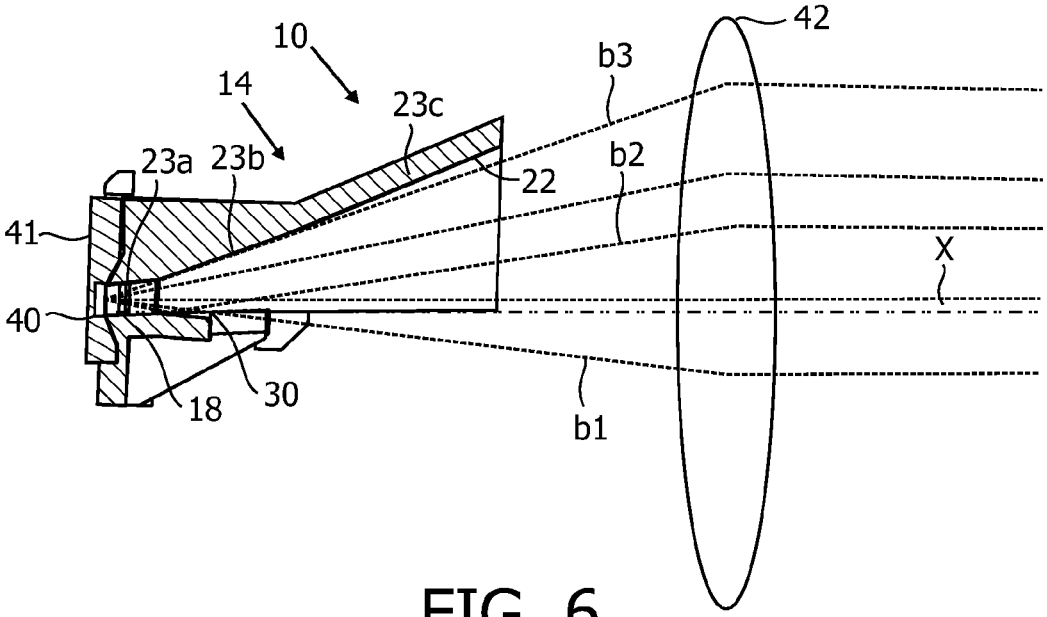
FIG. 6 shows a partly symbolical side view of an embodiment of a lighting arrangement including the collimator element of FIGS. 1-5 with beams demonstrating the emission pattern generation.
Figure 7:
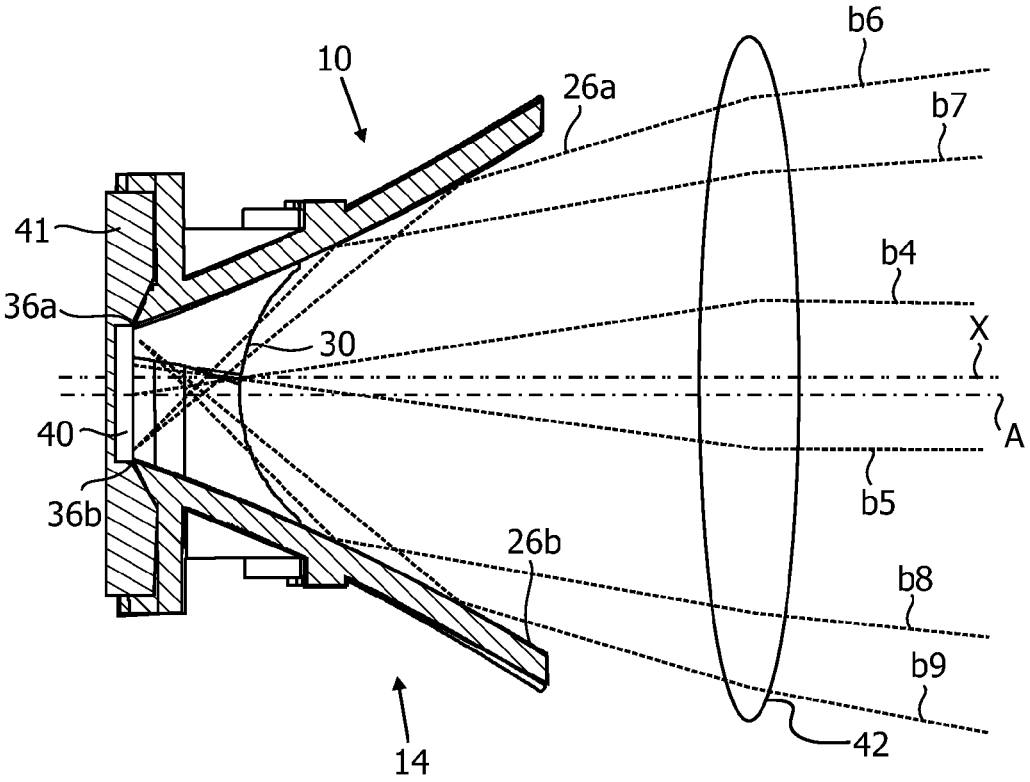
FIG. 7 shows in a partly symbolical sectional view a part of the lighting arrangement of FIG. 6.

FIGS. 6, 7 illustrate how the collimator 10 shapes the non-directional light emitted from the LED lighting element 40 to form an emission pattern with a desired angular intensity distribution. In vertical direction, the intensity distribution of the emitted light is shaped, as shown in FIG. 6, by the cutoff reflector surface 18 and the foreground reflector surface 22. Between these surfaces, which limit the emission angle of the LED element 40, light is directly emitted along the central geometrical axis A and within a defined angular range. The light emitted is then projected by a lens 42 acting as secondary optic element. The lens 42 has an optical axis X defined through the center of the lens 42 and its focal point. As shown in the figures, the optical axis X is parallel to the central geometrical axis A of the collimator 10, but slightly offset both in vertical and horizontal direction. In alternative embodiments, the central geometrical axis A may have a small angle with the optical axis X of up to 5° to account for the non-symmetrical resulting beam.

The cutoff reflector surface 18 is substantially shorter in the depth direction (direction of the axes X and A) than the rest of the funnel 14, i.e. foreground reflector surface 22 and lateral reflector surfaces 26*a*, 26*b*. It ends at a front edge, or shielding edge 30. The shielding edge 30 is arranged in a focal area of the lens 42, i.e. with a distance from the lens 42 which substantially corresponds to or is at least close to the focal distance of the lens 42.

As shown in FIG. 6, light emitted from the LED element 40 either passes the shielding edge 30 to be then projected by the projection lens 42 into a portion below a substantially horizontal light/dark cutoff (beam b1) within a light distribution projected by projection lens 42. Or, if the light is emitted at an angle that would otherwise be projected into a region above the desired light/dark cutoff, it strikes the cutoff reflector surface 18 and is, as shown in FIG. 6, reflected into a region below the cutoff (beam b2). It should be noted, as known to the skilled person, that the projection by projection lens 42 reverses the lighting distribution in horizontal direction, such that portions (beam b2, b3) appearing in FIG. 6 on top are projected into lower regions, whereas portions of the lighting distribution shown in FIG. 6 below are projected into upper regions, up to the light/dark cutoff line. Since the shielding edge 30 is arranged in the focus of the projection lens 42, the light/dark cutoff is projected as a (relatively) sharp image, such that a high contrast above and below the cutoff line is achieved.

The foreground reflector surface 22 shapes those parts of the beam that are intended to illuminate the road in front of the vehicle, i.e. the lower portions of the resulting lighting distribution (beam b3). It should be noted that the foreground reflector surface is comprised of three partial surfaces 23*a*, 23*b*, 23*c* arranged under different angles with the central geometrical axis A, with the angle increasing with increasing distance from the LED lighting elements 40. Generally, the angle of the foreground reflector surface is larger than that of the cutoff reflector surface 18. Further, as already mentioned, the foreground reflector surface 22 extends substantially further into the depth direction than the shielding edge 30, far beyond the focal area of the lens 42. This arrangement results in a desired intensity distribution of the projected light, where a relatively low intensity is achieved in regions to be projected directly in front of the motor vehicle, with increasing intensity to illuminate higher regions, further away in front of the vehicle.

FIG. 7 shows how the lateral reflector surfaces 26*a*, 26*b* serve to achieve a broad lighting distribution in lateral direction. Light emitted from the LED lighting element 40 centrally along or close to the central geometrical axis A strikes the projection lens 42 directly (beams b4, b5). The shielding edge 30 is in the focus of the lens 42. Portions of the light emitted under larger angles with the central axis X are reflected at the lateral reflector surfaces 26*a*, 26*b* (beams b6, b7, b8, b9). Since the beams b6, b7, b8, b9 are reflected at the lateral reflector surfaces 26*a*, 26*b* at positions closer to the lens 42 than the focal distance, they are projected divergently to achieve the desired broad beam.

Figure 8:
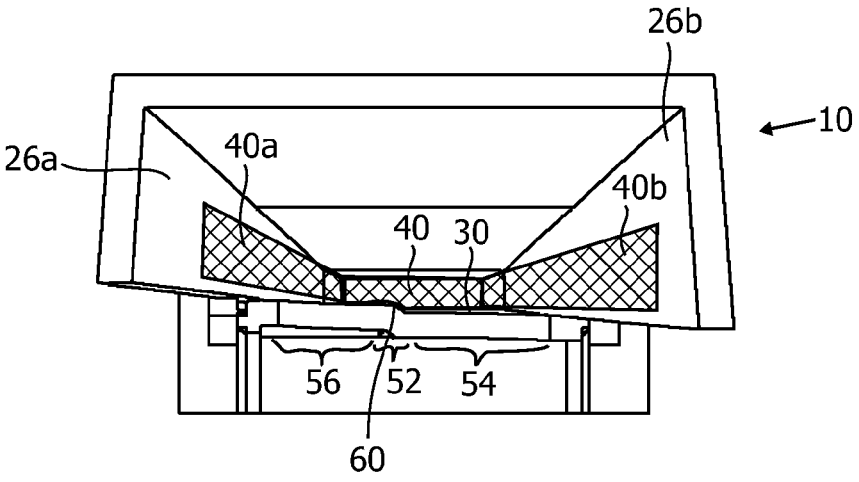
FIG. 8 shows in a partly symbolical front view of parts of the lighting arrangement according to FIG. 6, FIG. 7.

FIG. 8 illustrates how thus to both sides of the actual light emitting LED element 40, as viewed from the front of the collimator 10 along the optical axis X, images 40*a*, 40*b* are created by reflection at the lateral reflector surfaces 26*a*, 26*b*. The already asymmetrical LED element 40 thus appears to emit an even broader beam.

This emission pattern thus formed by the collimator 10 is then projected by the projection lens 42.

In the first embodiment of the collimator as shown in FIGS. 1-8, the shape of the surfaces 18, 22, 26 *a*, 26 *b* is specifically chosen to obtain a desired emission pattern of the emitted light. The opening angles of the cutoff reflector surface 18 and foreground reflector surface 22 have already been discussed. The lateral reflector surfaces are arranged under an opening angle of approximately 25° in the example shown. It should be noted that the lateral reflector surfaces 26 *a*, 26 *b*, as visible in the sectional views of FIGS. 5, 7, do not have a straight shape but exhibit a slight bend. Thus, the opening angle (angle between a tangent to the lateral reflector surface 26 *a*, 26 *b* and the central geometrical axis A) varies. A mean angle may be determined by regarding a straight line between the back edge 36 *a*, 36 *b* and opposing front edges of the lateral reflector surface 26*a*, 26 *b* and determining the angle of this line with the central geometrical axis A.

Figure 9:
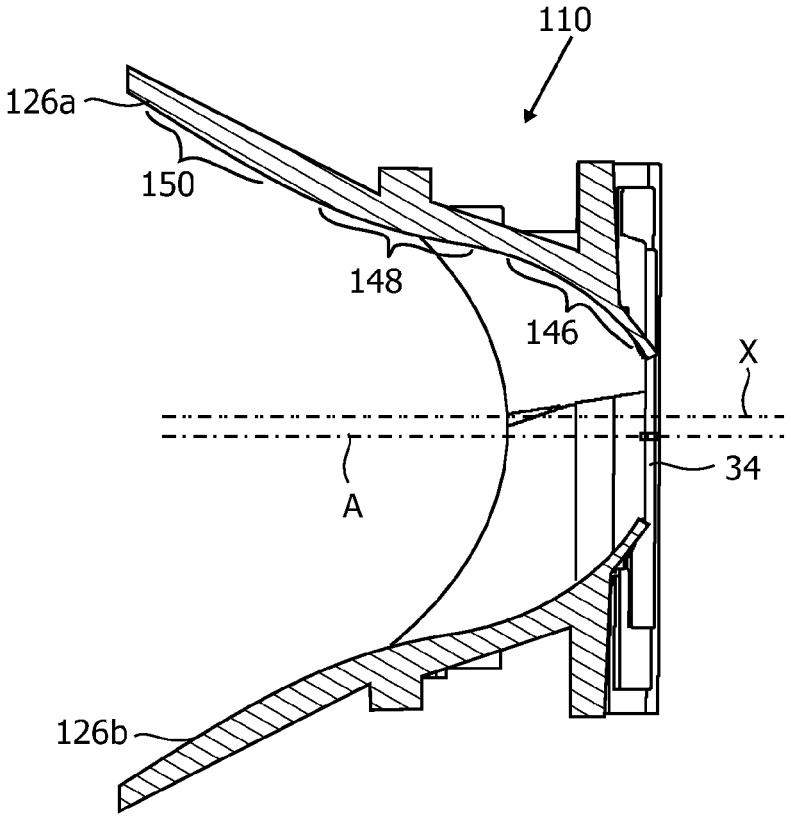
FIG. 9 shows a sectional view of a second embodiment of a collimator element with the section taken in the same plane as designated in FIG. 2 as B . . . B'.

In an alternative embodiment of a collimator 110 the shapes of lateral reflector surfaces 126 *a*, 126 *b* are different. Apart from this difference, the collimator 110 according to the second embodiment (FIG. 9) corresponds to the collimator 10 of the first embodiment (FIGS. 1-8), such that further details need not be explained.

In the collimator 110 according to the second embodiment, each lateral reflective surface 126*a*, 126*b* comprises different angle portions, i.e. portions where the reflective surface 126*a*, 126*b* has different opening angles with the central geometrical axis A. In a first angle portion 146, which is arranged close to the window 34, the opening angle is relatively large. In a second angle portion 148 positioned further away from the window 34, the opening angle is smaller than in the first angle portion 146. In a third angle portion 150, positioned again further away from the window 34 than the second angle portion 148, the opening angle is again larger than in the second angle portion. Through this S-shape of the lateral reflector surfaces 126*a*, 126*b*, a large portion of the light emitted from an LED element 40 positioned within the window 34 may efficiently be used.

As shown in FIGS. 1, 3, 7 and 8, the shielding edge 30 has a shape specifically chosen to obtain a corresponding desired shape of a light/dark cutoff line in the finally projected light beam.

Figure 3:
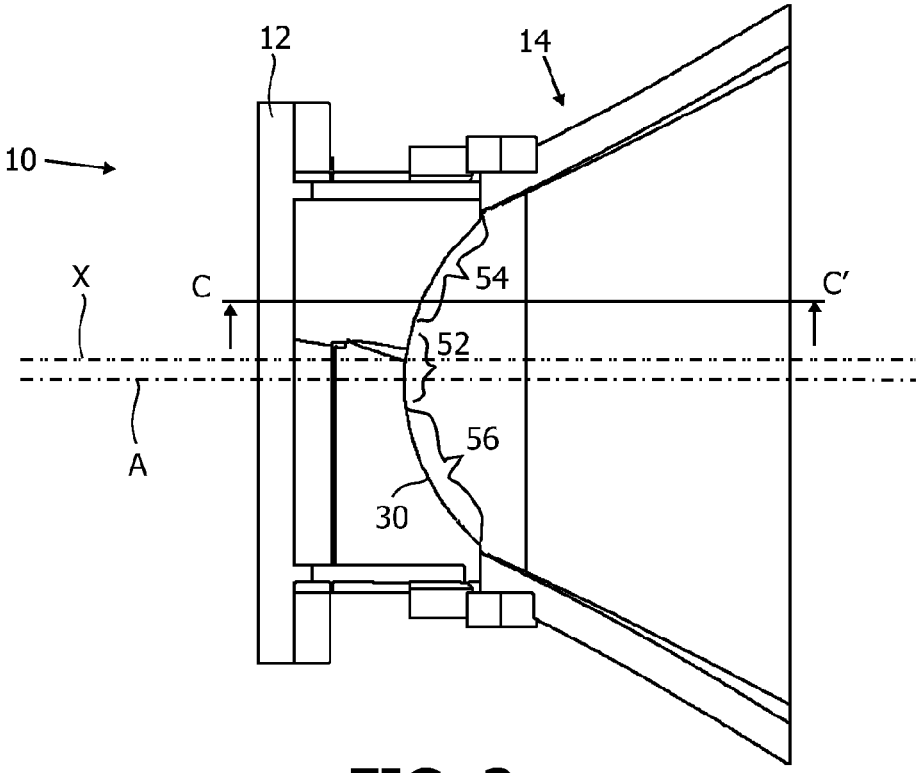
FIG. 3 shows the collimator element of FIG. 1, 2 in a bottom view.

As shown e.g. in FIG. 3, the shielding edge 30 has, as viewed from below, a shape corresponding to a curve running at varying distances from the back plate 12, and therefore from an LED element 40 installed therein. As shown, the curve of the shielding edge 30 is generally circular or elliptical, with an central portion 52 arranged closest to the LED lighting element 40 in depth direction, whereas outer portions 54, 56 are arranged further away from the LED element 40. In the lighting arrangement including the collimator 10 and the projection lens 42, the central portion 52 of the shielding edge 30 is arranged closest to the focal distance of the projection lens 42, such that a sharp projection image is obtained here.

FIG. 8 shows the shape of the shielding edge 30 as viewed from the front of the collimator 10 in the direction of the optical axis X. As shown here, the shielding edge 30 runs relatively straight in outer portions 54, 56. In the central portion 52, the shielding edge 30 comprises an angled portion—or kink—60 showing an angle of about 15°-45°, preferably about 30° with the straight portions 54, 56. The second outer portion 56 running substantially straight is substantially parallel to the first outer portion 54. This shape of the shielding edge 30 with an angled portion (kink) 60 in the center leads, if the angle 60 is arranged within the focal area of the projection lens 42, to a projected lighting distribution corresponding to regulations for automotive front lighting.

Figure 11:
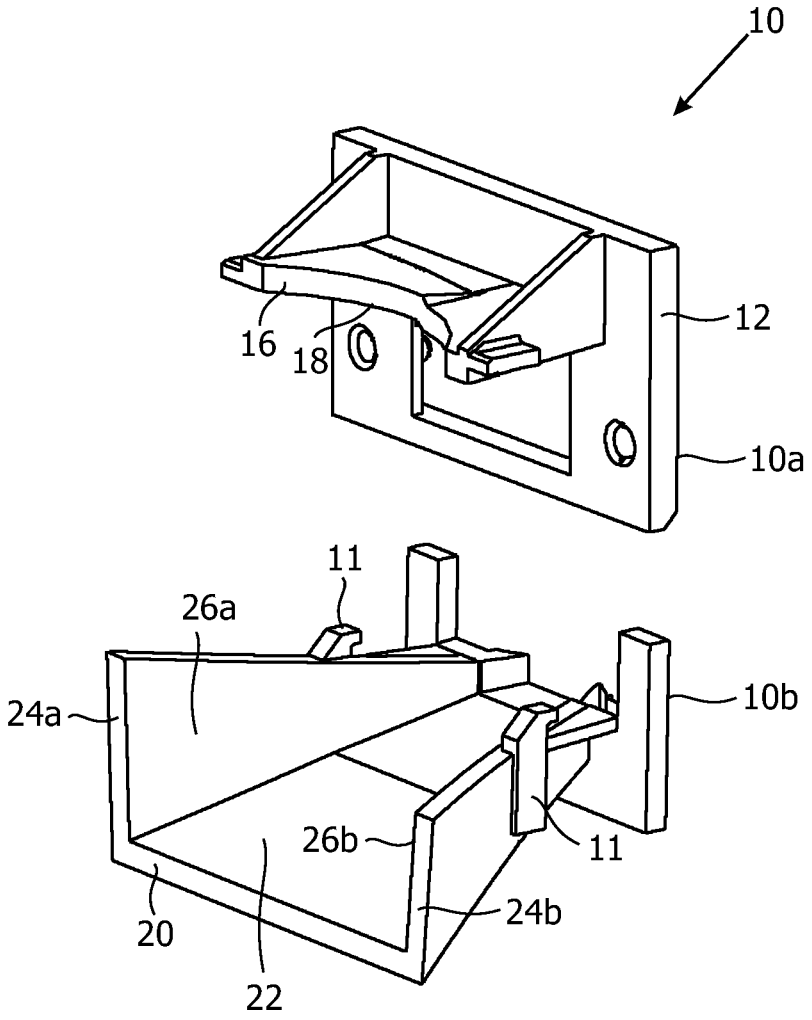
FIG. 11 shows a perspective exploded view of a collimator element.

A method for manufacturing the collimator element 10 described above may be understood in view of FIG. 11 showing a first part 10*a* and a second part 10*b* of the collimator element 10 in an exploded view. The first part comprises the back plate 12 and the cutoff reflector wall 16, whereas the second part 10*b* comprises the remaining parts of the funnel 14, namely the foreground reflector wall 20 and lateral reflector walls 24*a*, 24*b*.

Both parts 10*a*, 10*b* of the collimator 10 are separately manufactured from plastic in an injection moulding process.

It should be noted that of the four reflector surfaces of the funnel 14, the first part 10*a* only comprises the cutoff reflector surface 18. As explained above, the exact shape and the reflective properties of this surface play a central role, such that it is preferred to provide the cutoff reflector surface 18 with a very smooth and highly reflective coating. Such a coating may be provided e. g. as a Silver or Aluminum coating produced by evaporation, which may then be covered by a protective coating, e. g. out of $SiO_2$.

The fact that the first part 10*a* and second part 10*b* are separate allows to provide the remaining reflective surfaces, foreground reflector surface 22 and lateral reflector surfaces 26*a*, 26*b* with a reflective coating manufactured in a less expensive spray coating procedure.

The first and second parts 10*a*, 10*b* are assembled in a snap connection through fixing elements 11.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. Lighting arrangement comprising:

at least one LED lighting element having a primary optic arrangement for emitting light, at least one collimator for forming an emission pattern of said emitted light, and a secondary optic arrangement for projecting said emission pattern, wherein said collimator comprises:

a cutoff reflector surface with a front edge and a back edge, said back edge being located adjacent to said LED lighting element, and said front edge being spaced therefrom in a depth direction (X, A), said front edge being arranged as a shielding edge forming a light/dark cutoff in said emission pattern, and first and second lateral reflector surfaces arranged opposite to each other adjacent to said LED lighting element which flare out from an area nearest the LED lighting element, wherein said front edge of said cutoff reflector surface is arranged between the primary optic arrangement and the secondary optic arrangement at least substantially within a focal area of said secondary optic arrangement at a distance from the secondary optic arrangement that substantially corresponds to a focal distance of the secondary optic arrangement, wherein said first and second lateral reflector surfaces extend further into said depth direction (X, A) than said cutoff reflector surface, and beyond the focal area of the secondary optic arrangement, such that the resulting emission pattern has no sharp light/dark cutoff in lateral direction, and wherein said first and second lateral reflector surfaces have an S shape, with smooth transitions between angles, in cross-sectional view with at least a first angle portion that forms a first opening angle with a central geometrical axis (A) and a second angle portion that forms a second opening angle with the central geometrical axis (A), wherein said first angle portion is arranged closer to said LED lighting element than said second angle portion, and wherein said first opening angle is larger than said second opening angle.

2. Lighting arrangement according to claim 1, wherein said collimator further comprises a foreground reflector surface arranged opposite to said cutoff reflector surface, wherein said foreground reflector surface extends further into said depth direction (X, A) than said cutoff reflector surface.

3. Lighting arrangement according to claim 2, wherein said cutoff reflector surface, said foreground reflector surface and said lateral reflector surfaces each have back edges forming a window for said light emitted from said LED lighting element.

4. Lighting arrangement according to claim 1, wherein at least one of said first and second lateral reflector surfaces is arranged with an opening angle between said surface and a central geometrical axis (A), wherein said opening angle is measured from a back edge of said lateral reflector surface, which is arranged adjacent to said LED lighting element, and a front edge of said surface, which is arranged distant to said back edge in said depth direction (A), is 5°-45°.

5. Lighting arrangement according to claim 1, wherein a shape of said at first and second lateral reflector surfaces is continuous between said portions.

6. Lighting arrangement according to claim 1, wherein said front edge of said cutoff reflector surface has a shape corresponding to a curve running at varying distances from said LED lighting element in said depth direction (A, X).

7. Lighting arrangement according to claim 1, wherein said front edge of said cutoff reflector surface has a shape including two at least substantially straight portions and an angle portion arranged in between said straight portions.

8. Lighting arrangement according to claim 1, wherein said secondary optic arrangement comprises a lens.

9. Lighting arrangement according to claim 1, wherein at least one of said reflector surfaces of said collimator is a surface of a part made of plastic with a reflective coating provided on said surface.

10. Lighting arrangement according to claim 9, wherein said cutoff reflector surface and at least one of said lateral reflector surfaces are surfaces of at least one part made of plastic with a reflective coating, wherein the reflective coating provided on said cutoff reflector surface is different from a reflective coating provided on said lateral reflector surface.

11. Lighting arrangement according to claim 1, wherein said LED lighting element comprises a light emitting plane, wherein a length of said plane in a width direction is larger than a length of said plane in a height direction perpendicular thereto.

12. Lighting arrangement according to claim 1, wherein said first and second lateral reflector surfaces extend into said depth direction (X, A) by at least 50% further than said cutoff reflector surface.

13. Method for producing a lighting arrangement, comprising providing at least one LED lighting element having a primary optic arrangement for emitting light, providing at least one collimator for forming an emission pattern of said emitted light, providing a secondary optic arrangement for projecting said emission pattern, wherein providing said collimator comprises:

arranging a cutoff reflector surface with a front edge and a back edge, said back edge being located adjacent to said LED lighting element, and said front edge being spaced therefrom in a depth direction (A, X), said front edge being arranged as a shielding edge forming a light/dark cutoff in said emission pattern, arranging first and second lateral reflector surfaces opposite to each other adjacent to said LED lighting element which flare out from an area nearest the LED lighting element, arranging said front edge of said cutoff reflector surface between the primary optic arrangement and the secondary optic arrangement at least substantially within a focal area of said secondary optic arrangement at a distance from the secondary optic arrangement that substantially corresponds to a focal distance of the secondary optic arrangement, arranging so that said first and second lateral reflector surfaces extend further into said direction (A. X) than said cutoff reflector surface, and beyond the focal area of the secondary optic arrangement, such that the resulting emission pattern has no sharp light/dark cutoff in lateral direction, and arranging said first and second lateral reflector surfaces to have an S shape, with smooth transitions between angles, in cross-sectional view with at least a first angle portion that forms a first opening angle with a central geometrical axis (A) and a second angle portion that forms a second opening angle with the central geometrical axis (A), wherein said first angle portion is arranged closer to said LED lighting element than said second angle portion, and wherein said first opening angle is larger than said second opening angle.

14. Method according to claim 13, wherein at least a part of said collimator is made of plastic in an injection molding process, wherein a reflective coating is provided on a surface of said part to form one of said reflector surfaces.

* * * * *